US006814237B2

(12) United States Patent
Gorvett

(10) Patent No.: US 6,814,237 B2
(45) Date of Patent: Nov. 9, 2004

(54) ORGANIZER FOR COSMETICS

(76) Inventor: Sara L. Gorvett, 808 Red Barn La., Elgin, IL (US) 60123

( * ) Notice: Subject to any disclaimer, the term of this patent is extended or adjusted under 35 U.S.C. 154(b) by 194 days.

(21) Appl. No.: 10/093,223

(22) Filed: Mar. 7, 2002

(65) Prior Publication Data

US 2003/0168377 A1 Sep. 11, 2003

(51) Int. Cl.[7] ..... B65D 71/00
(52) U.S. Cl. ..... 206/581; 206/823
(58) Field of Search ..... 206/581, 823, 206/373, 764

(56) References Cited

U.S. PATENT DOCUMENTS 2,183,428 A * 12/1939 McNary ..... 206/479
2,292,029 A * 8/1942 Gold ..... 132/312
4,044,889 A * 8/1977 Orentreich et al. ..... 206/459.5
4,069,954 A * 1/1978 Rauch ..... 224/219
4,613,068 A * 9/1986 Bianchi ..... 224/242
4,736,876 A * 4/1988 Kriss ..... 224/148.1
5,174,447 A * 12/1992 Fleming ..... 206/373
5,718,023 A * 2/1998 Billish ..... 24/11 HC
5,816,408 A * 10/1998 Indelicato ..... 206/581
5,967,391 A * 10/1999 Hunt ..... 224/222
6,189,697 B1 * 2/2001 Davis ..... 206/581

* cited by examiner

*Primary Examiner*—Jila M. Mohandesi
(74) *Attorney, Agent, or Firm*—Banner & Witcoff, Ltd.

(57) ABSTRACT

A cosmetic holder is a band made of cloth, such as elastic, with a plurality of loops sized for holding and securing the cosmetic items such that a user may quickly locate, remove from the holder, use, and return to the holder a desired cosmetic item. The size of the loops is dependent on which cosmetic items are to be stored and organized. The cosmetic items ideally include a cap and a body, and the loops are sized for securing the cap. The cosmetic holder may include a covering that covers the lateral portions of the band and may cover the portion of the loops through which the cosmetic item extends to permit insertion of the cosmetic items to a proper extent. The surface or covering of the cosmetic holder may include information or aesthetic decoration. A clip may be included for securing the cosmetic holder.

9 Claims, 2 Drawing Sheets

ORGANIZER FOR COSMETICS

This application claims no priority.

FIELD OF THE INVENTION

The invention relates to carrying cosmetics, and particularly to a cosmetic holder for carrying and organizing cosmetics thereby providing ease in locating a particular cosmetic item from a selection when the ability to see the cosmetics or concentrate fully on finding a particular cosmetic may be hindered.

BACKGROUND OF THE INVENTION

Cosmetics come in all shapes and sizes, and are ubiquitous in the lives of many people including stage performers, field news reports, and many of ordinary women. Often times, cosmetics are applied in situations where the person is unable to devote their full attention to applying the cosmetic, or makeup. For instance, a news reporter in a vehicle rushing to the site of a new story may be applying makeup while looking out the window watching the action of the story unfold. Another instance is when a woman is putting on lipstick as she drives to work. Still another instance is when a stage performer has marred their makeup while coming off stage, and the makeup must be re-touched (corrected) before going back on stage in a short period of time.

In the event the person desiring to put on makeup is unable to devote their full attention to locating and applying the cosmetic item, each of the cosmetics ideally is located easily. As is the more common case, a purse or makeup bag will contain a number of lipsticks, eyeliners, lip-glosses, lip-balms, and other cosmetic items. The person who is, for instance, operating a motor vehicle and is simultaneously searching for a lipstick in a purse will oftentimes grab the first one that is found in a bag, examine it, determine it is not the desired lipstick, put it back, and reach for another until finding the desired lipstick (or other cosmetic item). Oftentimes, the cosmetic items are strewn about within a woman's pocketbook or purse, along with a variety of other things carried in the purse. The other items in the purse make it more difficult to find the desired, loose cosmetic, as well as the loose cosmetics make finding the other items in a purse or pocketbook more difficult to quickly locate without requiring a great share of a person's attention.

BRIEF SUMMARY OF THE INVENTION

In accordance with one aspect of the present invention, a cosmetic holder including a band with at least two loops sized for cosmetic items and securing the cosmetic items within the cosmetic holder is disclosed. The cosmetic holder may be comprised of cloth, and preferably elastic cloth where the cosmetic items are secured such that a user may simply remove or insert the cosmetic items, and where the cosmetic items otherwise remain secured. The loops may be sized for different sized cosmetic items. The cosmetic items ideally include a cap and a body, and the loops are sized for securing the cap.

The cosmetic holder may include a covering, and the covering may cover the lateral portions of the band and may cover the portion of the loops through which the cosmetic item extends. In such an embodiment, the cosmetic items may be inserted into the loops of the cosmetic holder, and the covering may permit insertion of the cosmetic items to a proper extent. The covering may be of a variety of materials, such as cloth or leather.

The cosmetic holder may include information on the surface of the cosmetic holder. The information may include identifying information of the cosmetic item secured therein, identifying information as to source or origin of the cosmetic holder, or identifying information as to source or origin of the cosmetic item. The cosmetic holder may include aesthetic decoration on the surface of the cosmetic holder. The cosmetic holder may include a clip for securing the cosmetic holder.

In accordance with a second aspect of the present invention, in combination with cosmetic items where one of the cosmetic items includes a cap and a body, a cosmetic holder including an elastic band with at least two loops, the loops sized for cosmetic items and securing cosmetic items within the cosmetic holder, the cosmetic items being secured such that a user may simply remove or insert the cosmetic items but the cosmetic items otherwise remain secured, the loops being sized for securing said cap, is disclosed. The cosmetic holder of the combination may include a covering that covers the lateral portions of the band and covers the portion of the loops through which the cosmetic item extends, where the cosmetic items are inserted into the loops of the cosmetic holder, and where the covering permits insertion of the cosmetic items such that the cap is secured and the body may be easily removed for using the cosmetic item. The cosmetic holder of the combination may include information on the surface of the cosmetic holder. The cosmetic holder of the combination may include aesthetic decoration on the surface of the cosmetic holder.

DETAILED DESCRIPTION OF THE INVENTION

Figure 1:
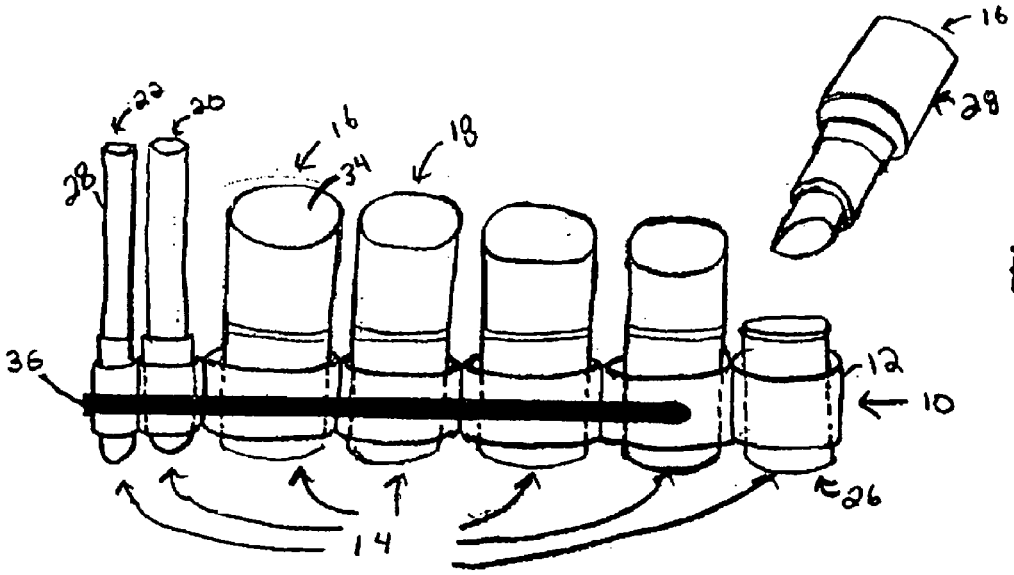
FIG. 1 is a perspective view of a first embodiment of a cosmetic holder of the present invention.

Referring to FIG. 1, a first embodiment of a cosmetic holder 10 of the present invention is depicted. The cosmetic holder 10 secures a plurality of cosmetic items 14. The cosmetic holder 10 comprises a band 12 with a generally one-piece construction made of elastic or another type of cloth whereby the cosmetic items 14 may be secured as to allow the deliberate insertion or removal of the cosmetic item 14 from the cosmetic holder 10 while retarding or preventing the accidental removal of the item 14.

Figure 2:
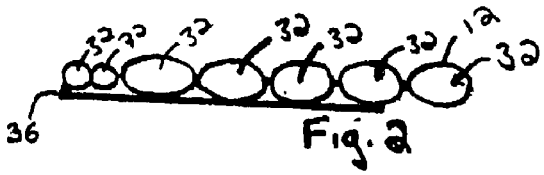
FIG. 2 is a top plan view of the first embodiment of the cosmetic holder of the present invention.

The band 12 is formed so as to have a plurality of loops 32, each loop sized for the cosmetic items 14 (see FIG. 2).

At least two loops 32 are provided as a minimum, while a maximum is determined primarily by the utility to a user based upon the size of the cosmetic holder 10 and number of cosmetics items 14 carried. Generally, the band 12 would include from three to seven loops as it is believed this is the range of number of items the most common user would carry. As depicted, the cosmetic items 14 may be lipstick 16, lip-gloss 18, lip-liner 20, and eyeliner 22. This list is meant to be exemplary and non-exclusive, as other cosmetic items may be secured (such as mascara).

The loops 32 are appropriately sized for the various cosmetic items 14. Generally, lipsticks 16, for instance, are within a narrow range of diametrical size. Lip-liner 20 and eyeliner 22 are also, generally, within a narrow range of diametrical size. The preferred material for the loops 32 is elastic cloth so that the slight variance in size of cosmetic items of a particular type is rendered generally irrelevant.

The ideal cosmetics items 14 for the cosmetic holder 10 are cosmetic items 14 with a two-piece body construction comprised of a cap 26 and a body 28 wherein the body 28 contains the makeup to be applied, and the cap 26 protects the makeup from physical or environmental damage. The cosmetic item 14 is inserted into a loop 32 such that the cap 26 is secured in the loop 32. In this manner, the body 28 may be removed for using and applying the cosmetic while the cap 26 remains secure.

The contents or makeup of cosmetic items 14 are identifiable by the exterior of the cosmetic item 14. The body 28 of a lipstick 16 has a bottom end 34 to which a label or identifying insignia is affixed. The body 28 of a lip-liner 20 or an eyeliner 22 has a band of color on its exterior designating both what the item 14 is (i.e., eyeliner 22) and what color the item 14 is.

In use, the holder 10 has a plurality of cosmetic items 14 secured therein as inserted by the user of the holder 10. When a user desires a particular item 14, the entire holder 10 and the items 14 may be located easily in a purse or pocketbook, and the holder 10 organizes the items 14. A user may glance at the items 14 in the array as secured so as to scan across the identifying information of the items 14. This allows a user to avoid fumbling through a purse or makeup bag for a particular item 14. Instead, the user is able to quickly locate by feel all desired makeup items 14 without looking away from, for example, a roadway upon which the user is driving. Then, the items 14 may be held up for selecting the desired item 14, often with a quick glance. The body 28 of the desired item 14 then may be removed from the cap 26 and holder 10, while the cap 26 remains secure. Once the makeup or cosmetic has been applied, the body 28 may be returned to the holder 10 and cap 26.

Figure 3A:
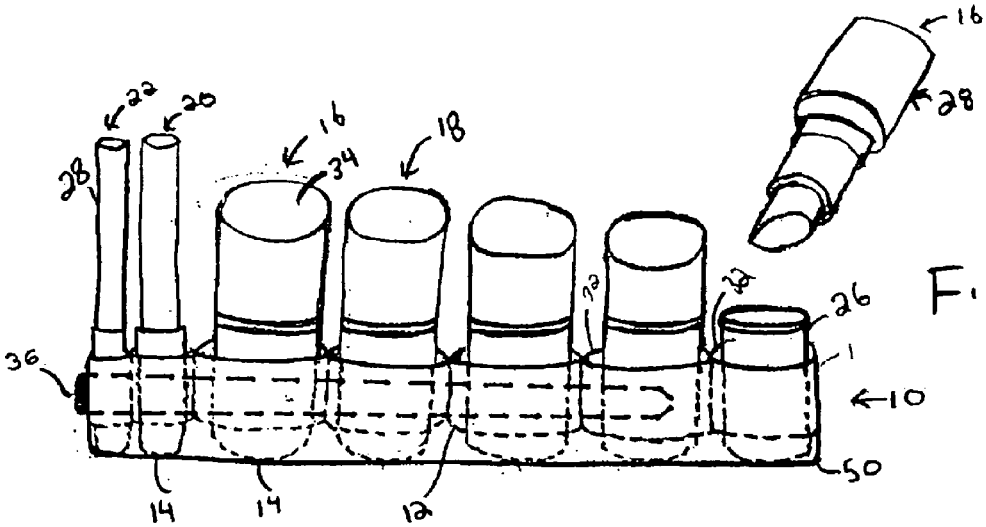
FIG. 3A is a perspective view of a second embodiment of a cosmetic holder of the present invention.
Figure 3B:
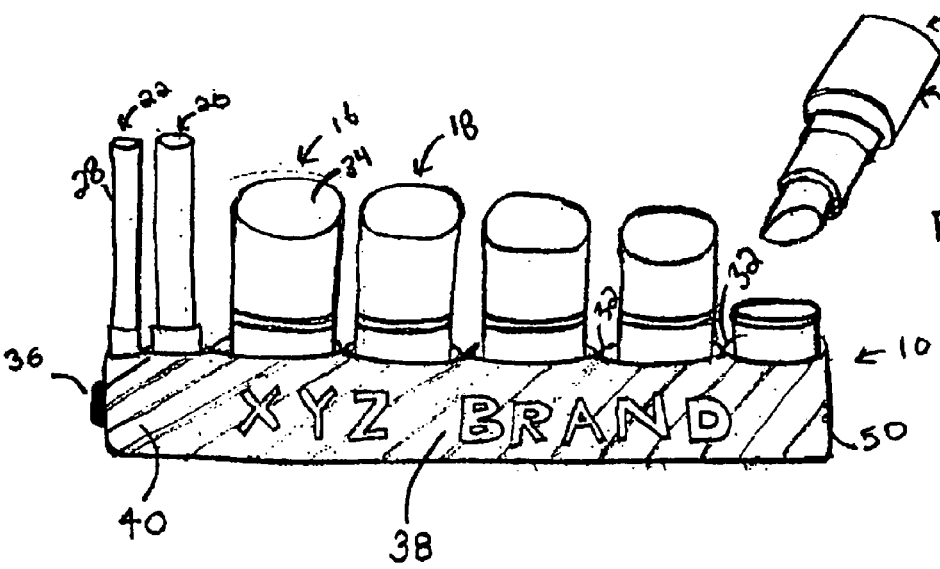
FIG. 3B is a perspective view of the second embodiment of a cosmetic holder of the present invention.

In an embodiment of the present invention depicted in FIGS. 3A and 3B, the cosmetic holder 10 may include an outer covering 50. The covering 50 is a generally cloth material that is attached to the loops 32 of the holder 10. Alternatively, the covering 50 may be leather or another material. The covering 50 covers the lateral portions and the bottom of the band 12, the bottom of the band being the portion through which the cap 26 of the cosmetic items 14 extends. The covering 50 provides a utility and an aesthetic to the holder 10. The utility of the covering 50 is that the covering 50 is designed so that a cap 26 of a cosmetic item 14 is not pushed through the loop 32 entirely, thereby preserving the ability of the body 28 to be easily removed. The aesthetic of the covering 50 is that covering 50 may by decorated with a design 40 (such as tie-dyed, or plaid, or colors) or a logo, such as a brand or trade name 38.

Furthermore, the aesthetic appeal and style of the cosmetic holder 10 may be enhanced or based upon the covering 50 or the band 12. Different holders 10 could be made for different seasons and decorated as such. In addition, the holders 10 could be made for different styles, such as a holder 10 for more formal events which require formal wear and items with similar cachet, or a holder 10 for other casual events, such as a baseball game or outing. The loops 32 and band 12 of the holder 10 could be decorated, or the covering 50 could be decorated.

The loops 32 may include a window (not shown) into which identifying information may be inserted. Alternatively, other means may be provided on the loops 32 for identifying information, or the means may be provided on the covering 50. The covering 50, if provided, or the loops 32 may also provide space for or be used for a design, identifying information of the makeup or the manufacturer, a logo, or a fashion designer's name.

It should be noted that certain changes could be made to the cosmetic holder 10. For example, a clip 36 could be added for securing the holder 10 to a particular portion of a purse or makeup bag. The arrangement of the loops 32 need not be in a line as is depicted in the FIGS. 1, 2, 3A, and 3B, instead being any other different arrangement, such as being in two rows, or in an arrangement whose configuration of loops 32 for eyeliner 22 or lipstick 16 are differently configured.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. In combination with cosmetic items, one of said cosmetic items including a cap and a body, a cosmetic holder comprising:

an elastic band including at least two loops, said loops sized for cosmetic items, and said loops thereby securing said cosmetic items within the cosmetic holder, wherein said cosmetic items are secured such that a user may simply remove or insert said cosmetic items wherein said cosmetic items otherwise remain secured, wherein said loops are sized for securing said cap;

wherein said cosmetic holder further comprises a covering wherein said covering covers only the lateral portions of the band and the portion of the loops through which the cosmetic item extends, wherein cosmetic items are inserted into said loops of the cosmetic holder, and wherein said covering permits insertion of the cosmetic items such that the cap is secured and the body may be easily removed for using the cosmetic item.

2. The combination of claim 1 wherein said cosmetic holder further includes aesthetic decoration on the surface of the cosmetic holder.

3. The combination of claim 1 wherein said cosmetic holder is comprised of cloth.

4. The combination of claim 3 wherein said cloth is elastic cloth.

5. The combination of claim 1 said cosmetic holder is comprised of leather.

6. The combination of claim 1 wherein said loops are sized for different sized cosmetic items.

7. The combination of claim 1 further including a clip for securing said cosmetic items.

8. In combination with cosmetic items, one of said cosmetic items including a cap and a body, a cosmetic holder comprising:

an elastic band including at least two loops, said loops sized for cosmetic items, and said loops thereby securing said cosmetic items within the cosmetic holder, wherein said cosmetic items are secured such that a user may simply remove or insert said cosmetic items, wherein said cosmetic items otherwise remain secured, wherein said loops are sized for securing said cap;

wherein said cosmetic holder further comprises a covering wherein said covering covers only the lateral portions of the band and the portion of the boos through which the cosmetic item extends, wherein cosmetic items are inserted into said loons of the cosmetic holder, and wherein said covering permits insertion of the cosmetic items such that the cap is secured and the body may be easily removed for using the cosmetic item;

wherein said cosmetic holder includes information on the surface of the cosmetic holder.

9. The combination of claim 8 wherein said information includes one or more of the following: identifying information of the cosmetic item secured therein; identifying information as to source of origin of the cosmetic holder; or identifying information as to source or origin of the cosmetic item.

* * * * *

UNITED STATES PATENT AND TRADEMARK OFFICE

CERTIFICATE OF CORRECTION

PATENT NO. : 6,814,237 B2
DATED : November 9, 2004
INVENTOR(S) : Gorvett, Sara L.

It is certified that error appears in the above-identified patent and that said Letters Patent is hereby corrected as shown below:

Title page,
Item [75], Inventor, insert -- Austin Gorvett --.

Signed and Sealed this

Fourth Day of October , 2005

JON W. DUDAS
*Director of the United States Patent and Trademark Office*